United States Patent [19]

Forth et al.

[11] Patent Number: 4,475,345

[45] Date of Patent: Oct. 9, 1984

[54] REFRIGERATOR WITH PNEUMATIC AND WORKING GAS-SUPPLY CONTROL

[75] Inventors: Hans-Joachim Forth, Cologne; Rolf Heisig, Weilerswist, both of Fed. Rep. of Germany

[73] Assignee: Leybold-Heraeus GmbH, Cologne, Fed. Rep. of Germany

[21] Appl. No.: 401,208

[22] Filed: Jul. 23, 1982

[30] Foreign Application Priority Data

Jan. 20, 1982 [DE] Fed. Rep. of Germany ..... 3201496

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 2,906,101 | 9/1959 | McMahon et al. | 62/6 |
| 3,148,512 | 9/1964 | Hoffman et al. | 62/6 |
| 3,188,819 | 6/1965 | Hogan | 62/6 |
| 3,188,821 | 6/1965 | Chellis | 62/6 |
| 3,205,668 | 9/1965 | Gifford | 62/6 |
| 3,218,815 | 11/1965 | Chellis et al. | 62/6 |
| 3,458,994 | 8/1969 | Heffner | 62/6 |
| 3,620,029 | 11/1971 | Longsworth | 62/6 |
| 3,636,719 | 1/1972 | Sato et al. | 62/6 |
| 3,640,082 | 2/1972 | Dehne | 62/6 |
| 3,717,004 | 2/1973 | O'Neil | 62/6 |
| 3,802,211 | 4/1974 | Bamberg et al. | 62/6 |
| 3,913,339 | 10/1975 | Berry | 62/6 |
| 4,060,996 | 12/1977 | Hanson | 62/6 |
| 4,092,833 | 6/1978 | Durenec | 62/6 |
| 4,143,520 | 3/1979 | Zimmerman | 62/6 |
| 4,206,609 | 6/1980 | Durenec | 62/6 |

*Primary Examiner*—Ronald C. Capossela

*Attorney, Agent, or Firm*—Felfe & Lynch

[57] ABSTRACT

A refrigerator has a cold producer with a pneumatically-operated displacer for displacing a working, cold-producing gas. The pneumatic and working gas-supply control is separate from the cold producer and connected thereto by tubes having volumes less than the maximum volumes of the portions of the chamber supplied thereby.

3 Claims, 2 Drawing Figures

REFRIGERATOR WITH PNEUMATIC AND WORKING GAS-SUPPLY CONTROL

BACKGROUND OF THE INVENTION

The invention relates to a refrigerator having a cold producer including at least one pneumatically operated displacer movable in a cylindrical chamber, and having an apparatus which serves for controlling the delivery of the working gas to the cylindrical chamber and the delivery of the gas necessary for the pneumatic operation of the displacer, plus a compressor for the gas supply.

Refrigerators are cryogenerators or low-temperature producing machines in which a thermodynamic cyclical process takes place (cf. U.S. Pat. No. 2,906,101, for example). One type of single-stage refrigerator is, essentially, a cylindrical chamber containing a reciprocating displacer. The chamber is connected alternately, in a certain manner, to a high-pressure gas reservoir and a low-pressure gas reservoir, so that the thermodynamic cyclical process (Stirling process, Gifford-McMahon process, etc.) takes place during the reciprocating movement of the displacer. The result is that heat is removed from one of the two ends of the chamber toward and away from which the displacer reciprocates. Temperatures down to less than 10K can be produced with two-stage refrigerators of this kind using helium as the working gas.

It is known, (cf. German Offenlegungsschrift Nos. 1,426,975, 1,501,049 and 2,051,203) to drive the displacer pneumatically and to use the working gas itself as the gas producing the pneumatic operation. In the refrigerators of German Offenlegungsschrift Nos. 1,426,975 and 1,501,049, the displacer is equipped with a driving piston the cylinder for which is connected by a gas control system to the high pressure or low pressure gas reservoir at the moment that is correct for the operation of the cyclical process. The gas control system serves furthermore for letting the working gas out of and into the cylinder of the displacer. In the subject matter of Offenlegungsschrift No. 2,051,203, a valve system additionally supplies a chamber with a volume of buffer gas. This chamber communicates with the hot end of the working cylinder through a throttle and has the effect of a pneumatic drive for operating the displacer.

In the actual (non-schematic) embodiments, shown in the above references the cold producer, i.e., the working cylinder with the displacer, forms with the gas control system (valve system or valve control rotor with drive) a single unit for which the expression "cold head" has become established. In order to put such a cold head in operation, it has to be connected to a suitable compressor through a low-pressure and a high-pressure line supplying the working gas. Additionally, an electrical connection must be made for the power supply of the valve control system or of an electric motor operating the valve control rotor. The connecting lines between the cold head and the compressor or power supply can be relatively long, so that for certain applications it is possible to set up the relatively small cold heat at a great distance from the supply apparatus. The small size of the unit producing the cold and the ease of making the connection between the cold head and its supply system are the important advantages of refrigerators over low-temperature apparatus operating with liquid refrigerants (bath cryostats and bath cryopumps or evaporator cryostats and evaporator cryopumps).

SUMMARY

It is the object of the present invention to design a refrigerator of the kind specified above such that the component that ultimately produces the cold will be still smaller and still lighter than heretofore.

In accordance with the invention, this object is accomplished by the fact that the cold producer and the gas control apparatus are separate units connected to one another by one or two conduits. By this measure, not only is a drastic reduction of the height, diameter and weight of the unit that actually produces the cold accomplished, but the additional important advantage is achieved that no electrical apparatus (electric motor, valve drives or the like) is needed in the direct vicinity of the cold producer. Such electrical apparatus can have a disturbing influence, especially in physical experiments being performed at low temperatures. Through the invention it is possible for refrigerator cryostats or refrigerator cryopumps to be contructed more compactly than heretofore. The result is an expansion of the possible applications of refrigerators. For example, with a cryogenerator of the invention, it is possible in a simple manner to cool the baffles of small diffusion pumps. On account of the formerly known method of constructing cold heads, in which the cold generator and gas control system are incorporated in a common unit, such an application was difficult or impossible for lack of sufficient space.

Although the reduction in the size of components is one of the important aims of modern engineering, and although the pneumatic operation of displacers in refrigerators has been known for about 20 years, the proposal of the invention, of "dividing" the cold head into the cold producer and the gas control unit has never before been practical.

DESCRIPTION OF A THE DRAWINGS

Additional advantages and details of the invention will be explained with the aid of the embodiments represented in the Figures in which FIG. 1 is a schematic of one embodiment and FIG. 2 is a schematic of another embodiment;

DESCRIPTION OF PREFERRED EMBODIMENTS

Figure 1:
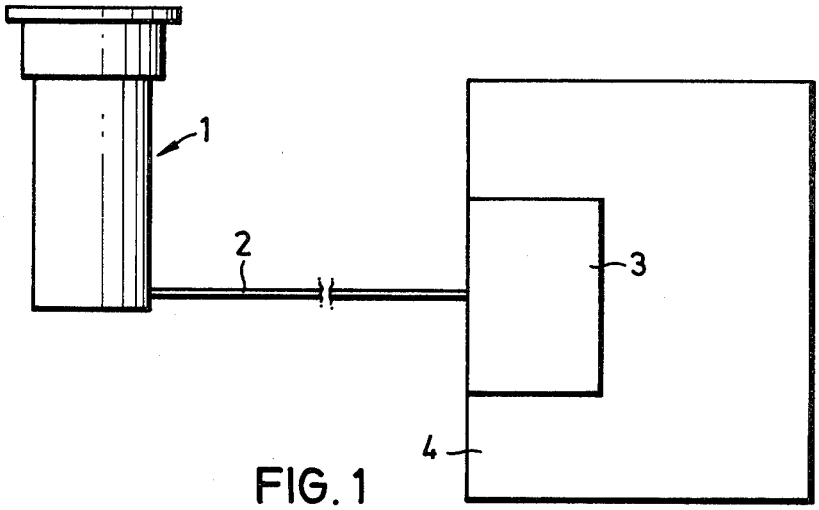

A single-stage cold producer 1 is represented in FIG. 1, as connected to a gas control system 3 through a lateral pipe 2. For reasons of space, the pipe 2 can also be alternatively to the bottom of cold producer 1. Only one supply line 2 between the gas control system 3 and the cold producer 1 suffices because the system for supplying a displacer in the cold producer 1 with working gas and a gas for pneumatic operation of the displacer are constructed in the manner disclosed in German Offenlegungsschrift No. 2,051,203. The gas control system 3 is disposed within a compressor 4 which as used herein, is a device to supply high-pressure and low-pressure gas to the cold generator 1 through the gas control system 3. The compressor 4 and the gas control system 3 thus constitute a single unit of construction.

Figure 2:
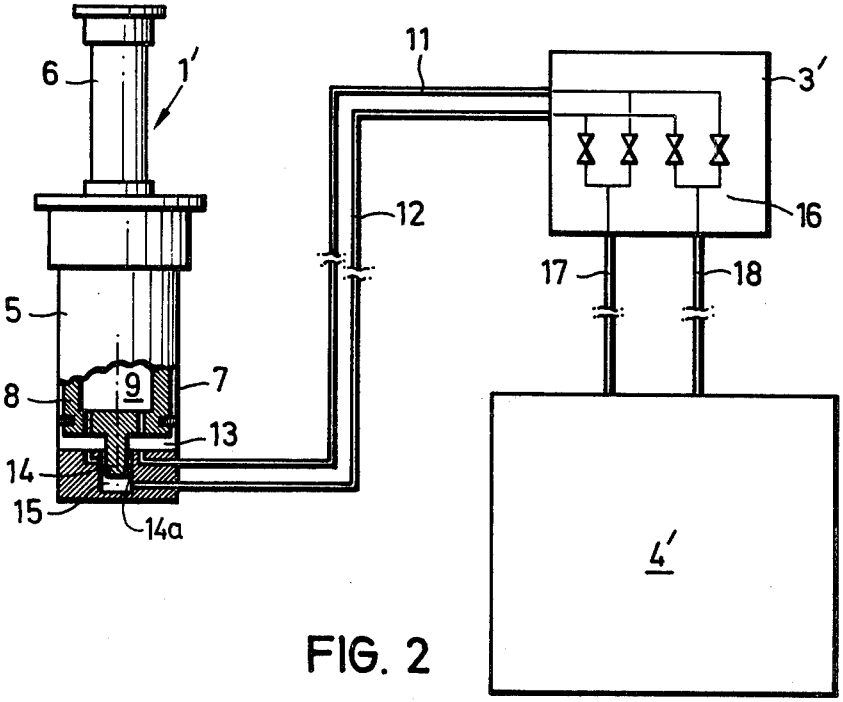

FIG. 2 shows a cold producer 1' having two stages 5 and 6, one above the other. The hotter stage 5 is shown partially cut away so that the hollow displacer 8 which can reciprocate up and down in the cylindrical chamber 7 can be seen. A regenerator, which is not shown, is contained in the chamber or hollow 9 of displacer 8.

The cold producer 1' is connected by two preferably-flexible tubes 11 and 12 to the gas control system 3'. These lines can also be connected either to the side or to the bottom of the cold producer 1'. The length of the lines can easily amount to several meters, e.g., 5 to 6 meters, without substantially impairing the operation or efficiency of the refrigerator.

The line 11 serves to supply working gas to the working portion 13 of a cylindrical chamber 7 and therefore leads directly thereto. The gas that is for pneumatically driving the displacer 8 is fed through tube 12. The displacer has a driving piston 14 with a seal **14*a* across the chamber the opposite sides of which separate another, driving portion 15 of the chamber 7 from the working portion 13. Line 12 leads directly into chamber portion 15**.

Since the amount of gas needed for driving the displacer 8 can be substantially smaller than the amount of working gas serving for optimum operation of the cold producer, the tube 12 can have a substantially smaller diameter than the tube 11. In general, the volume of the connecting lines 11 and 12 should not be greater than the maximum volume of the chamber portions 13 (including connected regenerator hollow 9 in the displacer) and 15 respectively supplied by them, the maximum volume being determined by the excursion of the opposite sides of the seal of the piston part of the displacer which separates the chamber portions.

The gas control system 3 serves to supply the lines 11 and 12 with alternately changing gas pressures. A valve system 16, which supplies the line 11 and 12 with high pressure (e.g., 22 bar) and low pressure (e.g., 5 bar) at the moment that is correct in each case for the cyclical process and for driving therefore the displacer, serves for this in a manner that is known and therefore not described in detail. The production of these gas pressures is performed by the compressor 4', which in the embodiment represented in FIG. 2 is connected to the gas control system 3 by two, low- and high-pressure lines 17 and 18.

Instead of the system 16 consisting of a plurality of valves, a rotatory valve control means can be provided which alternately connects the lines 17 and 18 to the lines 11 and 12. Such valve control rotors are known, and are disclosed, for example, in German Offenlegungsschrift Nos. 1,426,975 and 1,501,049.

We claim:

1. A refrigerator, comprising:

a cold producer (1) having a chamber and a displacer (8) in the chamber having a driving piston (14) with a seal **(14*a*) across the chamber for pneumatically reciprocating the displacer in the chamber with an operating gas introduced into a portion (15) of the chamber on one side of the seal and displacing thereby a working gas in a portion (13)** of the chamber on the opposite side of the seal, whereby the volumes of the chamber portions on the opposite sides of the seal alternately have a maximum;

a compressor (4) for providing the gasses at appropriate pressures; gas-control means (3) separate from the cold producer controllably feeding the gasses form the compressor supply thereof in a manner to reciprocate the displacer with the operating gas and provide the working gas to be displaced thereby for refrigeration; and first and second tubes (11, 12) connecting the cold producer to the separate gas-control means for respectively feeding the working and operating gasses from the latter to the chamber portions of the former respectively having the gasses for reciprocating and displacing operation thereof, the volume of each tube being not greater than the maximum volume of the chamber on the opposite sides of the displacer respectively fed gas thereby.

2. Refrigerator of claim 1, wherein the gas control means (3) and compressor (4) are a single unit.

3. Refrigerator of claim 1, wherein the diameter of the tube (11) for the working gas is larger than the diameter of the tube (12) for the operating gas.

* * * * *